US008230898B2

(12) United States Patent
Hirata et al.

(10) Patent No.: US 8,230,898 B2
(45) **Date of Patent: *Jul. 31, 2012**

(54) CORE-SETTING METHOD AND APPARATUS FOR A MOLDING APPARATUS FOR PRODUCING FLASKLESS MOLDS

(75) Inventors: Minoru Hirata, Toyokawa (JP); Koichi Sakaguchi, Toyokawa (JP)

(73) Assignee: Sintokogio, Ltd., Aichi (JP)

( * ) Notice: Subject to any disclaimer, the term of this patent is extended or adjusted under 35 U.S.C. 154(b) by 125 days.

This patent is subject to a terminal disclaimer.

(21) Appl. No.: 12/744,471

(22) PCT Filed: Nov. 26, 2008

(86) PCT No.: PCT/JP2008/071441

§ 371 (c)(1),
(2), (4) Date: May 24, 2010

(87) PCT Pub. No.: WO2009/069652

PCT Pub. Date: Jun. 4, 2009

(65) Prior Publication Data

US 2010/0252220 A1 Oct. 7, 2010

(30) Foreign Application Priority Data

Nov. 28, 2007 (JP) ..... 2007-306722

(51) Int. Cl.
*B22D 33/04* (2006.01)

(52) U.S. Cl. ..... 164/397; 164/30; 164/137; 164/340

(58) Field of Classification Search ..... 164/30, 164/137, 340, 397

See application file for complete search history.

(56) References Cited

U.S. PATENT DOCUMENTS 3,910,343 A * 10/1975 Popov et al. ..... 164/340

(Continued)

FOREIGN PATENT DOCUMENTS

JP 5-245582 9/1993

(Continued)

OTHER PUBLICATIONS

JPO machine translation of JP 05-245582 A, Sep. 24, 1993.*

International Search Report corresponding International application No. PCT/JP2008/071441 dated Feb. 17, 2009.

*Primary Examiner* — Jessica L Ward

*Assistant Examiner* — Kevin E Yoon

(74) *Attorney, Agent, or Firm* — Finnegan, Henderson, Farabow, Garrett & Dunner, L.L.P.

(57) ABSTRACT

These inventions provide a method and an apparatus for setting a core used in a molding apparatus that produces flaskless molds, wherein the core-setting apparatus has a simple structure and the accuracy of the positioning of the core while setting it on the lower mold is improved. The inventions comprise:

moving a first carrier 52 carrying a core-handling tool 51 which is holding the core 70 toward the cope flask 2 by means of a second carrier 53 when the cope flask 2 is located at the mold-stripping mechanism 12 being lifted to a lifted position by means of a flask-rotation mechanism 13;

transferring the first carrier and the core-handling tool to the cope flask which is at the lifted position;

lowering the cope flask 2, the core-handling tool 51, and the first carrier 52 by means of the flask-rotation mechanism 13 so that the core 70 comes close to or contacts the lower mold; and releasing the core 70 from the core-handling tool 51 to set the core on the lower mold.

3 Claims, 7 Drawing Sheets

U.S. PATENT DOCUMENTS

| | | | | |
|---|---|---|---|---|
| 4,590,982 | A * | 5/1986 | Hunter | 164/253 |
| 4,848,440 | A * | 7/1989 | Hunter | 164/253 |
| 6,868,894 | B2 * | 3/2005 | Knudsen | 164/340 |
| 2007/0151694 | A1 * | 7/2007 | Hirata et al. | 164/19 |
| 2009/0121381 | A1 | 5/2009 | Hirata | |
| 2009/0121382 | A1 * | 5/2009 | Hirata et al. | 264/219 |

FOREIGN PATENT DOCUMENTS

| | | | |
|---|---|---|---|
| WO | WO 02/43901 | A1 | 6/2002 |
| WO | WO 2006/134798 | A1 | 12/2006 |

* cited by examiner

CORE-SETTING METHOD AND APPARATUS FOR A MOLDING APPARATUS FOR PRODUCING FLASKLESS MOLDS

TECHNICAL FIELD

These inventions relate to a method and an apparatus for setting a core used in a molding apparatus for producing an upper and a lower mold having no flask, where the core is set on the lower mold on which the upper mold is stacked.

BACKGROUND OF THE INVENTION

Conventionally, as one core-setting apparatus that is used for a molding apparatus for producing a pair of an upper and a lower mold having no flask by using a match plate, there is a type of core-setting apparatus that sets a core on the lower mold from a core-holder after a drag flask containing the lower mold is placed directly under the core-setting apparatus. (See Patent Document 1.)

Patent Document 1:

Pamphlet of International Patent Laid-open Publication No. WO 02/43901 (See FIG. 3.)

DISCLOSURES OF INVENTIONS

However, for the conventional apparatus, since the drag flask must be transferred to the outside of the molding apparatus over a long distance, it becomes a problem in that the structure of the molding apparatus becomes complicated. Further, since a core is set on the lower mold by lifting the drag flask under the condition that the drag flask is supported in a cantilevered state, it becomes another problem in that it is hard to transfer the lower mold to the core while keeping it in an accurate position.

The present inventions have been conceived to solve these problems. Namely, the objective of them is to provide a core-setting apparatus used for a flaskless molding apparatus and a method for setting a core on a lower mold, wherein the structure of the molding apparatus and the core-setting apparatus can be simplified and the accuracy of the positioning of the core while setting it on the lower mold can be improved.

To solve these problems, the method of these inventions for setting a core is used in a molding apparatus for producing flaskless molds comprises:

two pairs of a cope flask and a drag flask, each pair having a sand-filling inlet on a sidewall;

a match plate to be transferred to and from the space between one of the pairs of the cope and the drag flask by a transfer mechanism;

a squeezing mechanism for squeezing molding sand, which mechanism holds the match plate between the pair of the cope and the drag flask, and has an upper and a lower squeezing means that is insertable into an opening of the pair of the cope and the drag flask where there is no match plate, and is constructed such that the pair of the cope and the drag flask which is holding the match plate rotates from a perpendicular position to a horizontal position in a substantially perpendicular plane around a horizontal shaft;

a rotating means to rotate the squeezing mechanism clockwise and counterclockwise;

a sand-filling mechanism to feed molding sand through the sand-filling inlet into the pair of the cope and the drag flask which is disposed at the perpendicular position by the rotating means;

a mold-stripping mechanism to strip the upper and lower molds made of the molding sand from the cope and the drag flasks which are stacked together and disposed at a horizontal state containing the upper and lower molds;

a flask-rotation mechanism to alternately transfer the two pairs of the stacked cope and the drag flask between the squeezing mechanism and the mold-stripping mechanism in a circular motion, having a means to lift and lower the cope flask;

wherein the core is set on the lower mold by the method comprising:

moving a first carrier carrying a core-handling tool which is holding the core toward the cope flask by means of a second carrier when the cope flask is located at the mold-stripping mechanism being lifted to a lifted position by means of the flask-rotation mechanism;

transferring the first carrier and the core-handling tool to the cope flask which is at the lifted position;

lowering the cope flask, the core-handling tool, and the first carrier by means of the flask-rotation mechanism so that the core comes close to or contacts the lower mold; and releasing the core from the core-handling tool.

These inventions include the following technical features:

moving a first carrier carrying a core-handling tool which is holding the core toward the cope flask by means of a second carrier when the cope flask is located at the mold-stripping mechanism being lifted to a lifted position by means of the flask-rotation mechanism;

transferring the first carrier and the core-handling tool to the cope flask which is under a lifted condition;

lowering the cope flask, the core-handling tool, and the first carrier by means of the flask-rotation mechanism so that the core comes close to or contacts the lower mold; and releasing the core from the core-handling tool to set the core on the lower mold.

Since these inventions have these technical features, they have various types of effects, such as enabling the structure of the molding and core-setting apparatus to be simplified, and improving the accuracy of the position of the core when the core is set on the lower mold.

BRIEF DESCRIPTIONS OF THE DRAWINGS

PREFERRED EMBODIMENTS OF THE INVENTIONS

Figure 1:
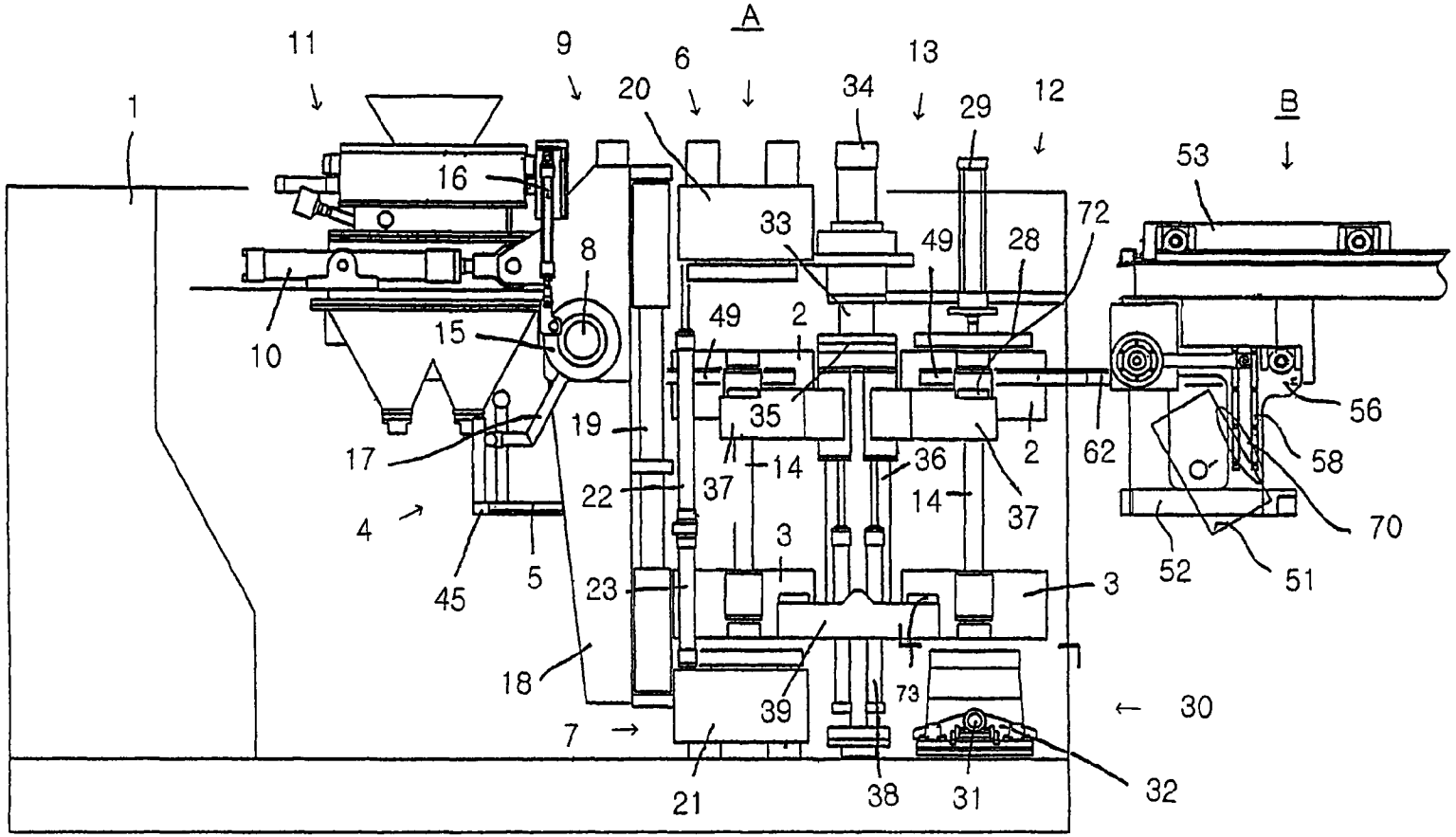
FIG. 1 is an elevational view of the flaskless molding apparatus.

One embodiment of a core-setting apparatus B that is used for a flaskless molding apparatus A for producing a pair of flaskless molds of these inventions is now explained in detail based on FIGS. 1-7. As in FIG. 1, the molding apparatus A comprises:

a cuboid-shaped main frame 1 having a space inside it;

two pairs of a cope flask 2 and a drag flask 3, each flask having a sand-filling inlet on a sidewall;

a match plate 5 to be transferred to and from the space between one of the pairs of the cope flask 2 and the drag flask 3 by a transfer mechanism 4;

a squeezing mechanism 9 for squeezing molding sand, which mechanism holds the match plate 5 between the pair of the cope flask 2 and the drag flask 3, and has an upper and a lower squeezing means 6, 7 that is insertable into an opening which is arranged to face the match plate 5 when the match plate 5 is held between the pair of the cope flask 2 and the drag flask 3, and is constructed such that the pair of the cope flask 2 and the drag flask 3 which is holding the match plate 5 rotates from a perpendicular (the longitudinal direction in FIG. 1) position to a horizontal (the transverse direction in FIG. 1) position in a substantially perpendicular plane around a horizontal shaft 8 which is disposed at the main frame 1;

a horizontal cylinder 10 working as a rotating means to rotate the squeezing mechanism 9 clockwise and counterclockwise;

a sand-filling mechanism 11 to feed molding sand through the sand-filling inlets into the pair of the cope flask 2 and the drag flask 3 which is disposed at the perpendicular position by means of the horizontal cylinder 10;

a mold-stripping mechanism 12 to strip the upper and lower molds made of the molding sand from the cope flask 2 and the drag flask 3, which are stacked together and disposed at a horizontal state, containing the upper and lower molds; and a flask-rotation mechanism 13 to alternately transfer the two pairs of the stacked cope flask 2 and the drag flask 3 between the squeezing mechanism 9 and the mold-stripping mechanism 12 in a circular motion, the flask-rotation mechanism 13 having a means to lift and lower the cope flask 2 by hooking the cope flask 2.

Further, as in FIG. 1, each of the cope flasks 2 has a pair of connecting rods 14, 14 which are suspended from the front and the rear outer-surfaces (only the front outer-surface is shown in FIG. 1: the rear outer-surface is behind the front outer-surface) of the cope flask 2. The drag flask 3 is disposed slidably along the pair of the connecting rods 14, 14 and stoppable at the bottom ends of the connecting rods 14, 14.

The cope flasks 2 are provided with projections 72 on the middle of the front and the rear end sections, and the drag flasks 3 are provided with projections 73 on the right side (when the drag flask 3 is positioned at the squeezing mechanism 9) of the front and the rear end sections.

Also, the cope flasks 2 are provided with first rails 49, which extend from side to side on the front and the rear surfaces of the cope flasks 2. Wheels 57, 57 of the first carrier 52 of the core-setting apparatus B, which will be discussed below, are placed on the first rails 49.

As in FIG. 1, the transfer mechanism 4 for the match plate 5 comprises: a ring member 15 attached around the horizontal shaft 8 of the squeezing mechanism 9;

a first cylinder 16 pivotally supported on the sand-filling mechanism 11 and the distal end of its piston rod being rotatably connected to the ring member 15;

a pair of arms 17,17 supported on the ring member 15 in a cantilevered state;

a suspended-type carrier 45 movable right and left for transferring the match plate 5.

The carrier 45 is movable right and left by rotational and sliding movements of the arms 17, 17 driven by the extension and contraction of the first cylinder 16, while the carrier 45 is being lowered over a predetermined and short distance by the movement of the cope flask 2.

As in FIG. 1, the squeezing mechanism 9 has the horizontal shaft 8, which is supported on the upper center of a main frame 1, and a swinging frame 18 which is fixed on the horizontal shaft 8 and pivotally swung about the horizontal shaft 8 clockwise and counterclockwise.

On the right side (the right as in FIG. 1) of the swinging frame 18, a pair of first guiding rods 19, 19 is installed at right angles to the horizontal shaft 8. The guiding rods 19, 19 are spaced apart at a predetermined distance in the front-back direction (perpendicular to FIG. 1).

The pair of guiding rods 19, 19 has a reverse-L-shaped upper lifting frame 20 at one end and an L-shaped lower lifting frame 21 at the other end. The upper and lower lifting frames 20, 21 are slidable along the pair of guiding rods 19, 19, and approach and retract from each other by extending and contracting movements of the piston rod of an upwardly operable second cylinder 22 and a downwardly operable third cylinder 23, which are installed on the swinging frame 18. When the upper and lower lifting frames 20, 21 come close to each other, the cope flask 2 and the drag flask 3 are held between the upper and lower lifting frames 20, 21.

The sand-filling mechanism 11 is installed on the left upper position of the main frame 1. The sand-filling mechanism 11 has two sets of fluidizing means (not shown) that ejects compressed air to fluidize the molding sand at the bottom of the sand-filling mechanism 11 where the sand-ejection nozzles are located.

When the molding sand is fed to the cope flask 2 and the drag flask 3 from the sand-filling mechanism 11, the molding sand is pressurized by supplying compressed air on it under the condition that the molding sand is fluidized by ejecting compressed air through the two sets of the fluidizing means.

The mold-stripping mechanism 12 comprises an stripping plate 28 which can be inserted into the pair of the cope flask 2 and the drag flask 3. The pair is disposed in a stacked and horizontal condition. The stripping plate 28 is fixed on the distal end of a piston rod of a fourth cylinder 29, which is downwardly operable, and movable in a perpendicular direction by extending and contracting the downwardly operable fourth cylinder 29.

A mold-receiving apparatus 30 for receiving the upper and lower mold stripped from the cope flask 2 and the drag flask 3 is located directly under the stripping plate 28.

The mold-receiving apparatus 30 is provided with a lifting table (not shown) which can be lifted and lowered by a pantograph 32 by means of the extension and contraction of the piston rod of a fifth cylinder 31.

The flask-rotation mechanism 13 comprises a rotating shaft 33 which extends perpendicularly and which is rotatably mounted on the main frame 1 around a perpendicular axis. The upper end of the rotating shaft 33 is connected to an output shaft of a motor 34 which is mounted on the top of the main frame 1. The shaft 33 rotates 180 degrees clockwise and counterclockwise by means of the motor 34.

Further, a supporting member 35 is fixed at the upper part of the rotating shaft 33. The supporting member 35 has two pairs of perpendicularly extending second guiding rods 36, 36, which are suspended therefrom and symmetrically arranged about the rotating shaft 33.

Each pair of the guiding rods 36, 36 has an upper hooking member 37. Each slides perpendicularly along the guiding rods 36, 36 and can be hooked on the projections 72 of the cope flasks 2. Each hooking member 37 is connected to the distal end of a piston rod of an upwardly operable sixth cylinder 38 which is disposed at the rotating shaft 33. Each hooking member 37 is moved up and down by extending and contracting the piston rod of the upwardly operable sixth cylinder 38.

Further, a lower hooking member 39 is fixed to the lower ends of the two pairs of the guiding rods 36, 36. The projections 73 of the two drag flasks 3 can hook on the lower hooking member 39.

Next, the core-setting apparatus B is explained by reference to FIG. 2.

The core-setting apparatus B comprises:

a core-handling tool 51 to hold and release a core 70 by means of a conventional clamping mechanism or a suctioning mechanism;

a first carrier 52 to carry the core-handling tool 51 to the cope flask 2 when the cope flask 2 is lifted by the means of the flask-rotation mechanism 13 while the cope flask 2 is positioned at the mold-stripping mechanism 12 of the molding apparatus A;

a second carrier 53 to move the core-handling tool 51 and the first carrier 52 to and from the mold-stripping mechanism 12;

a transferring mechanism 54 disposed at the second carrier 53 to transfer the first carrier 52 together with the core-handling tool 51 to the mold-stripping mechanism 12; and a controlling means 55 to control the core-handling tool 51 and the transferring mechanism 54.

Further, the holding surface of the core-handling tool 51 for holding the core 70 is upwardly or downwardly flipped by a reversing motor (not shown) which is mounted on the first carrier 52.

Figure 2:
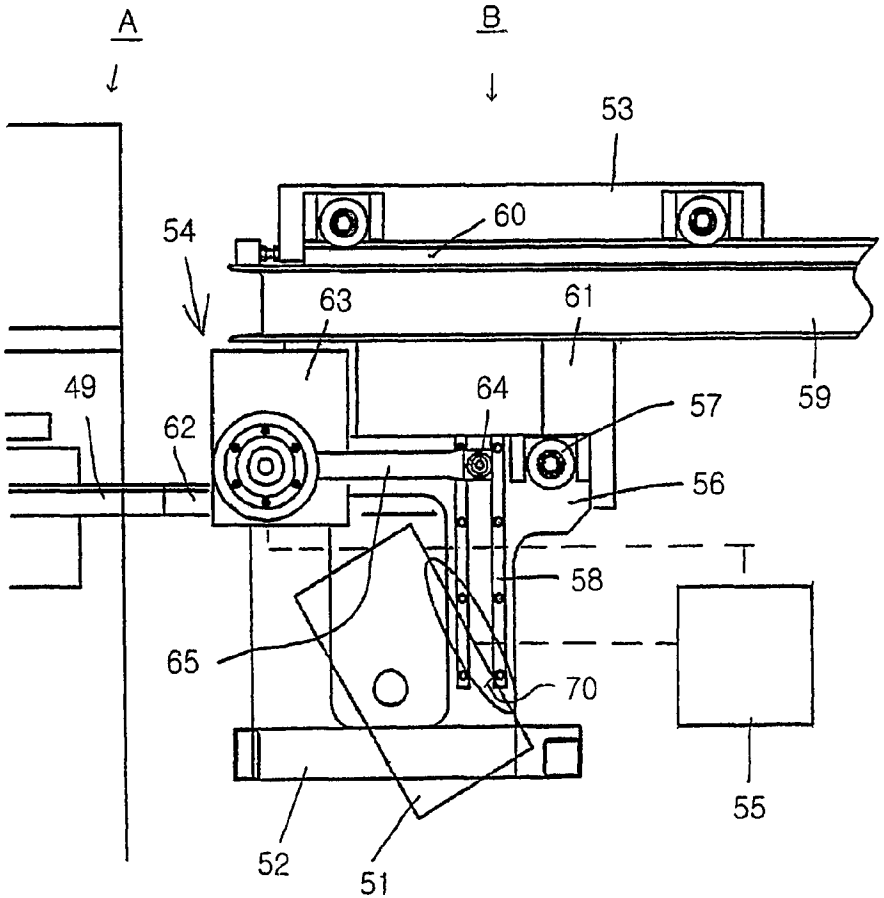
FIG. 2 is a close up view of the flaskless molding apparatus in FIG. 1.

The first carrier 52 has a pair of T-shaped and perpendicularly extending columns 56, 56 on the front and rear edges (only the front edge is shown in FIG. 2: the rear edge is behind the front surface) of the top surface of the first carrier 52. V-grooved wheels 57, 57 are rotatably fitted to the left and right side (left and right in FIG. 2) of the upper parts of the columns 56, 56. The column 56 on the front edge has two parallel guide rails 58, 58 which extend perpendicularly.

The second carrier 53 is movably disposed on parallel rails 60 which are mounted on a gate-shaped solid frame 59 which is installed on the right side (the right in FIG. 2) of the molding apparatus A.

The second carrier 53 can move right and left (as in FIG. 2) along the parallel rails 60 (toward the molding apparatus A). The transferring mechanism 54 is suspended from the bottom of the second carrier 53 by supporting members 61. Further, horizontally-extending second rails 62 are fixed on the supporting members 61 so that the second rails 62 are level with the first rails 49, when the first rails 49 are raised along with the cope flask 2. The wheels 57 of the first carrier 52 are put on the second rails 62. Namely, the first carrier 52 is suspended from the second rails 62. Thus, the core-handling tool 51 and the core 70 are positioned below the cope flask 2.

The transferring mechanism 54 comprises:

a driving motor 63 mounted on the supporting member 61;

an arm 65 fixed to an output shaft of the driving motor 63;

and a disc 64 which is rotatably disposed on the distal end of the arm 65 so that the disc 64 can move up and down while rotating between the parallel guide rails 58, 58.

The first carrier 52 can move right and left (as in FIG. 2) on the second rails 62 and the first rails 49 of the cope flask 2 when the arm 65 is swung clockwise and counterclockwise by the driving motor 63. Namely, since the first carrier 52 is suspended below the first and second rails 49, 62, the first carrier 52 can move right and left along the rails together with the core-handling tool 51 and the core 70 at a level lower than that of the cope flask 2.

Figure 3:
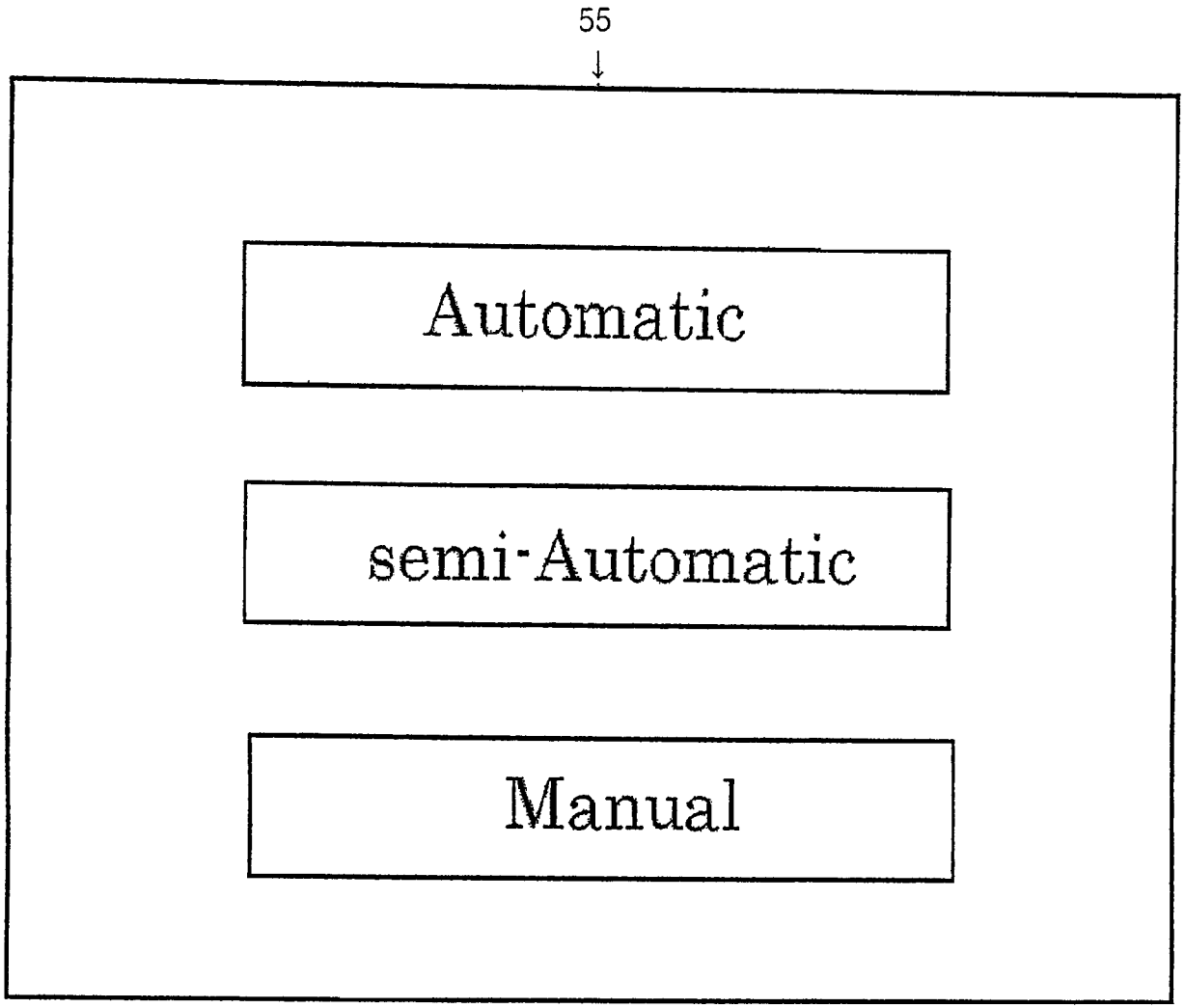
FIG. 3 is a close up view of the controlling means of FIG. 2.

The controlling means 55 comprises an electrical circuit for automatic, semi-automatic, and manual operation of the core-setting apparatus B, and a switching means for switching the type of operation modes, as in FIG. 3. Under an automatic mode, a full process of core-setting will be executed automatically. Under a semi-automatic mode, the process of core-setting will be divided into some steps, and each step will be executed separately from the other steps. Under a manual mode, it is possible to operate a plurality of actuators manually and independently.

Therefore, the process of core-setting can be performed in a fast, accurate, and efficient manner under the automatic mode. Also, under the semi-automatic mode, it is possible to clean the core, or to check the quality of the molds between each step of the process of core-setting. Under the manual mode, it is possible to adjust the cycle time of the process of core-setting, or to optimize or to check the performance of the core-setting apparatus.

Below, the operations to mold the upper and lower flaskless molds starting from the state shown in FIG. 1, and the operations to set the core 70 on the lower mold using the apparatus having the constitution explained in the above paragraphs are explained.

First, the match plate 5 is transferred to the space between the cope flask 2 and the drag flask 3 with the pair of the arms 17, 17 by extending the first cylinder 16 of the transfer mechanism 4 of the molding apparatus A, while the cope flask 2 and the drag flask 3 are in a horizontal condition.

Next, the cope flask 2 and the drag flask 3 are moved to come close to each other by contracting the piston rods of the second and the third cylinders 22, 23, which are upwardly and downwardly operable respectively, of the squeezing mechanism 9 and the sixth cylinder 38, so that the upper lifting frame 20 and the upper hooking member 37 are lowered and the lower lifting frame 21 is lifted, and so that finally the match plate 5 is held between the cope flask 2 and the drag flask 3.

Then, an upper molding space and a lower molding space are defined by inserting the upper and the lower squeezing means 6, 7 into the cope flask 2 and the drag flask 3 to predetermined distances respectively, while the squeezing mechanism 9 is rotating clockwise about the horizontal shaft 8 by extending the horizontal cylinder 10 so that the pair of the cope flask 2 and the drag flask 3 and the match plate 5 become perpendicular.

As a result of this operation, the sand-filling inlets of the cope flask 2 and the drag flask 3 move upward and contact the bottom nozzles of the sand-filling mechanism 11.

Next, the molding sand is ejected from the sand-filling mechanism 11 into the upper and lower molding spaces through the sand-filling inlets.

Then, the upper and the lower squeezing means 6, 7 are further inserted into the cope flask 2 and the drag flask 3 respectively to squeeze the molding sand, while the cope flask 2, the drag flask 3 and the match plate 5 are being moved back to a horizontal condition. After the squeezing operation is completed, the squeezing means 6, 7 are retracted from the cope flask 2 and the drag flask 3 respectively.

Next, the upper and the lower lifting frames 20, 21 are moved away from each other by extending the piston rods of the upwardly operable second cylinder 22 and the downwardly operable third cylinder 23. Then, the cope flask 2, which contains the upper mold made of the squeezed molding sand, is lifted and separated from the match plate 5 by lifting the upper hooking member 37 by extending the piston rod of the sixth cylinder 38 of the flask-rotation mechanism 13. The drag flask 3 is put on the lower hooking member 39 of the flask-rotation mechanism 13.

Then, by contracting the piston rod of the first cylinder 16, the match plate 5 is retracted from the space between the cope flask 2 and the drag flask 3 with the arms 17, 17.

The cope flask 2 and the drag flask 3 that contains the upper and lower molds are thereafter transferred to the mold-stripping mechanism 12 by rotating the rotating shaft 33 of the flask-rotation mechanism 13 to a predetermined angle by means of the motor 34.

Next, as in FIGS. 1 and 2, after the core 70 is placed on the holding surface of the core-handling tool 51, the holding surface is turned to face downward. Then, the second carrier 53 is moved toward the mold-stripping mechanism 12 so that the edges of the second rails 62 contact the edges of the first rails 49.

Figure 4:
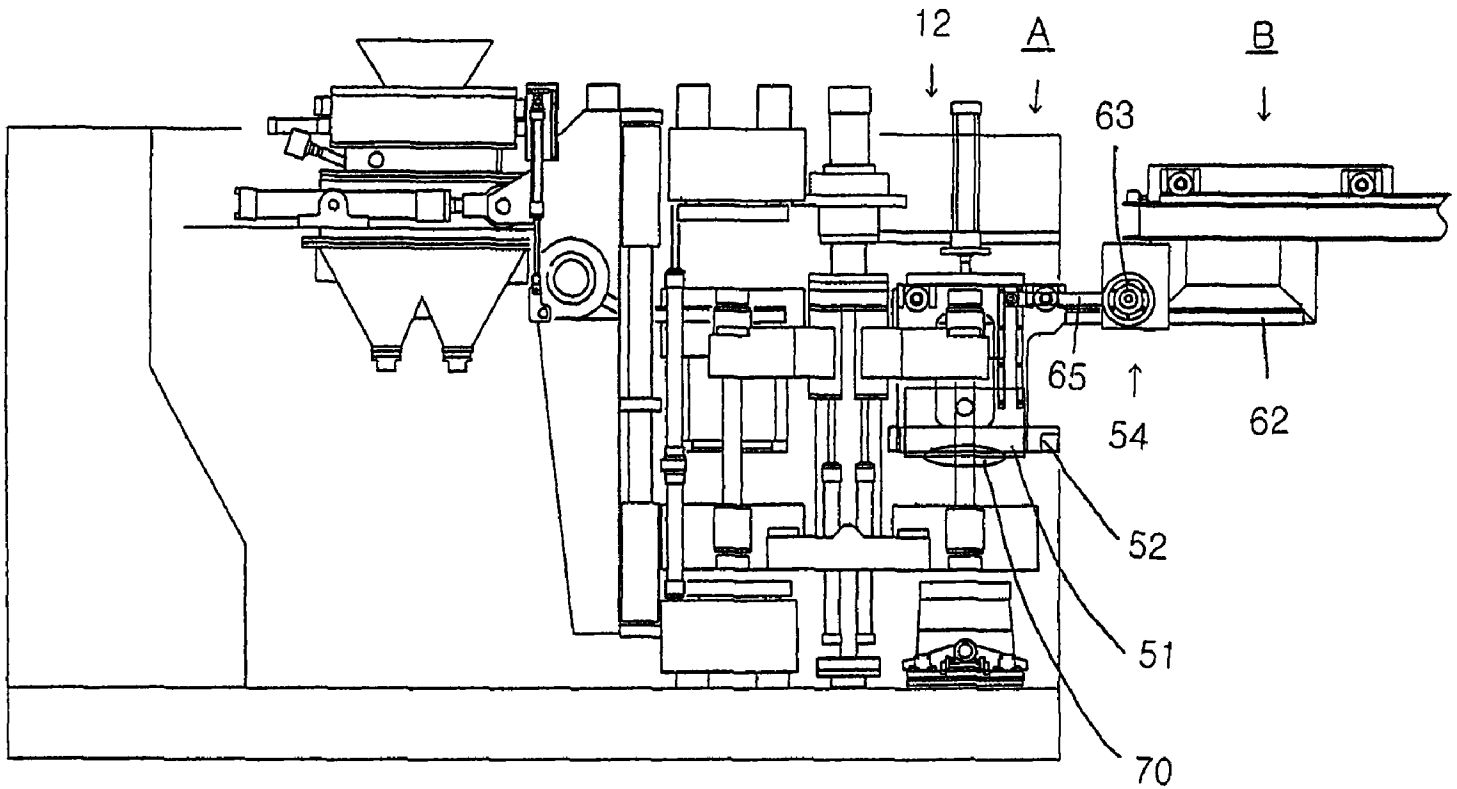
FIG. 4 is an operational view using the flaskless molding apparatus of FIG. 1.

As in FIG. 4, the arm 65 is swung clockwise by means of the driving motor 63 of the transferring mechanism 54 so that the first carrier 52 moves from the second rails 62 to the first rails 49. As a result of this operation, the core-handling tool 51 and the first carrier 52 are transferred to the cope flask 2, which is located at the mold-stripping mechanism 12 at a lifted position.

Figure 5:
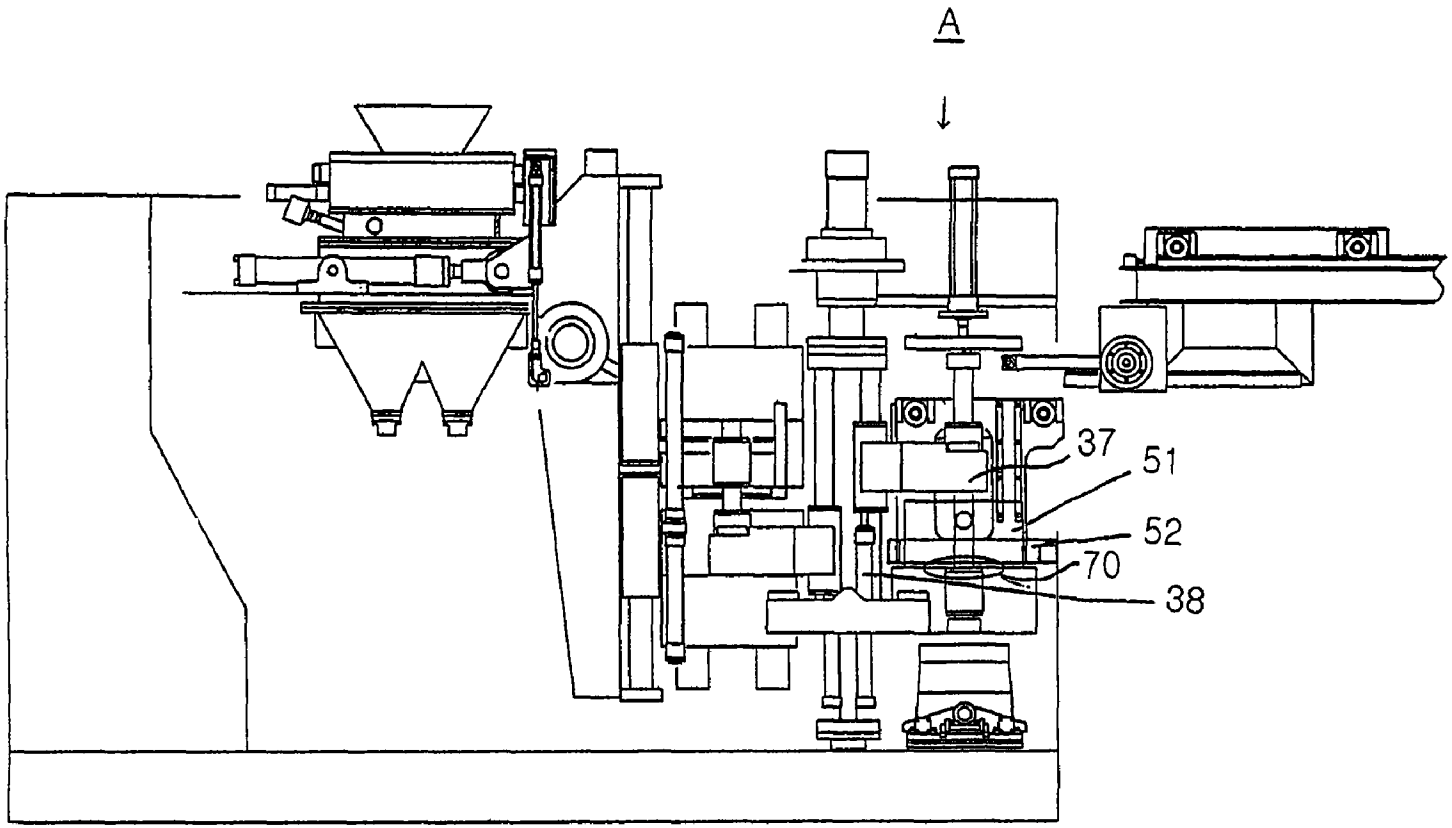
FIG. 5 is an operational view using the flaskless molding apparatus of FIG. 1.

Then, as in FIG. 5, the core-handling tool 51, the first carrier 52 and the cope flask 2, are lowered by contracting the sixth cylinder 38 so that the core 70 approaches or contacts the lower mold.

Figure 6:
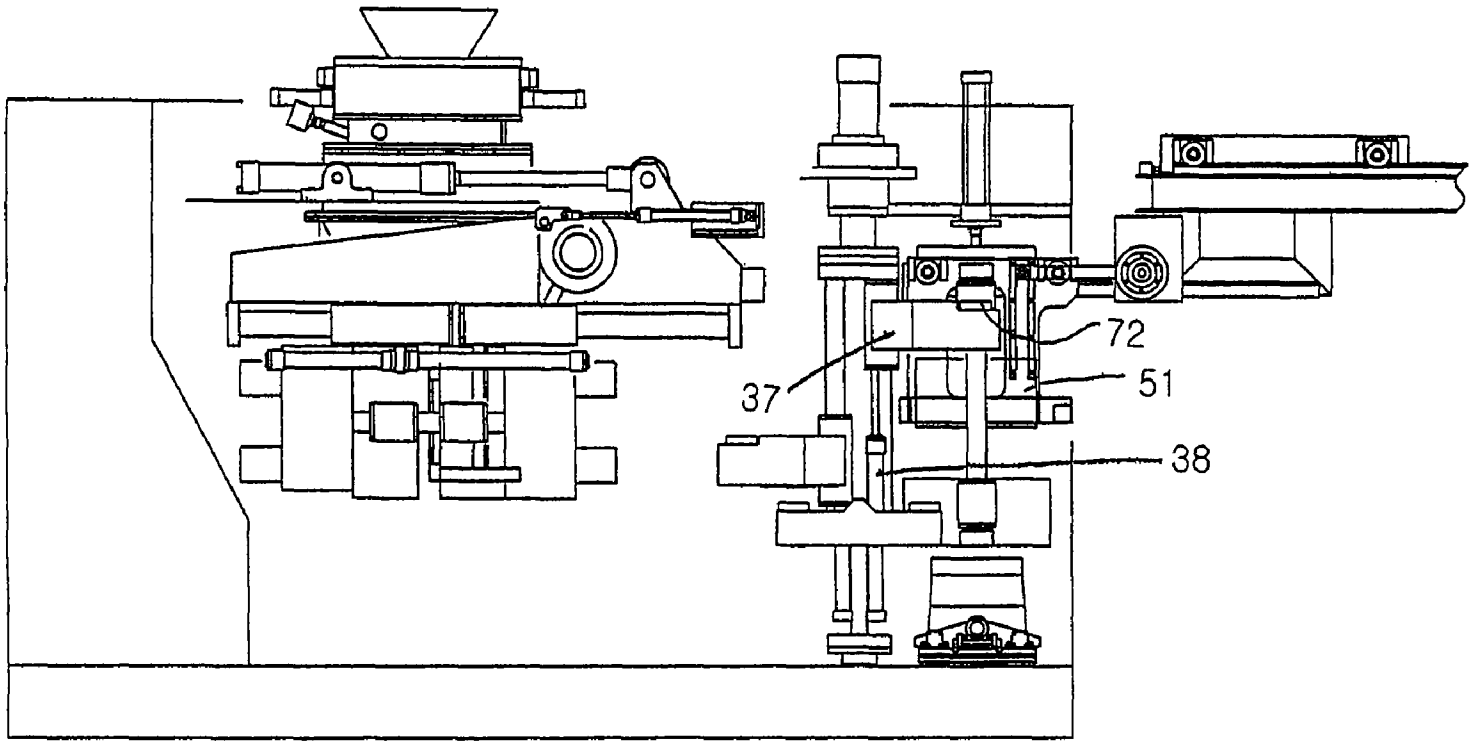
FIG. 6 is an operational view using the flaskless molding apparatus of FIG. 1.

Next, as in FIG. 6, the core 70 is set on the lower mold by releasing the core 70 from the core-handling tool 51. The cope flask 2 and the upper hooking member 37 are thereafter lifted by extending the sixth cylinder 38.

Figure 7:
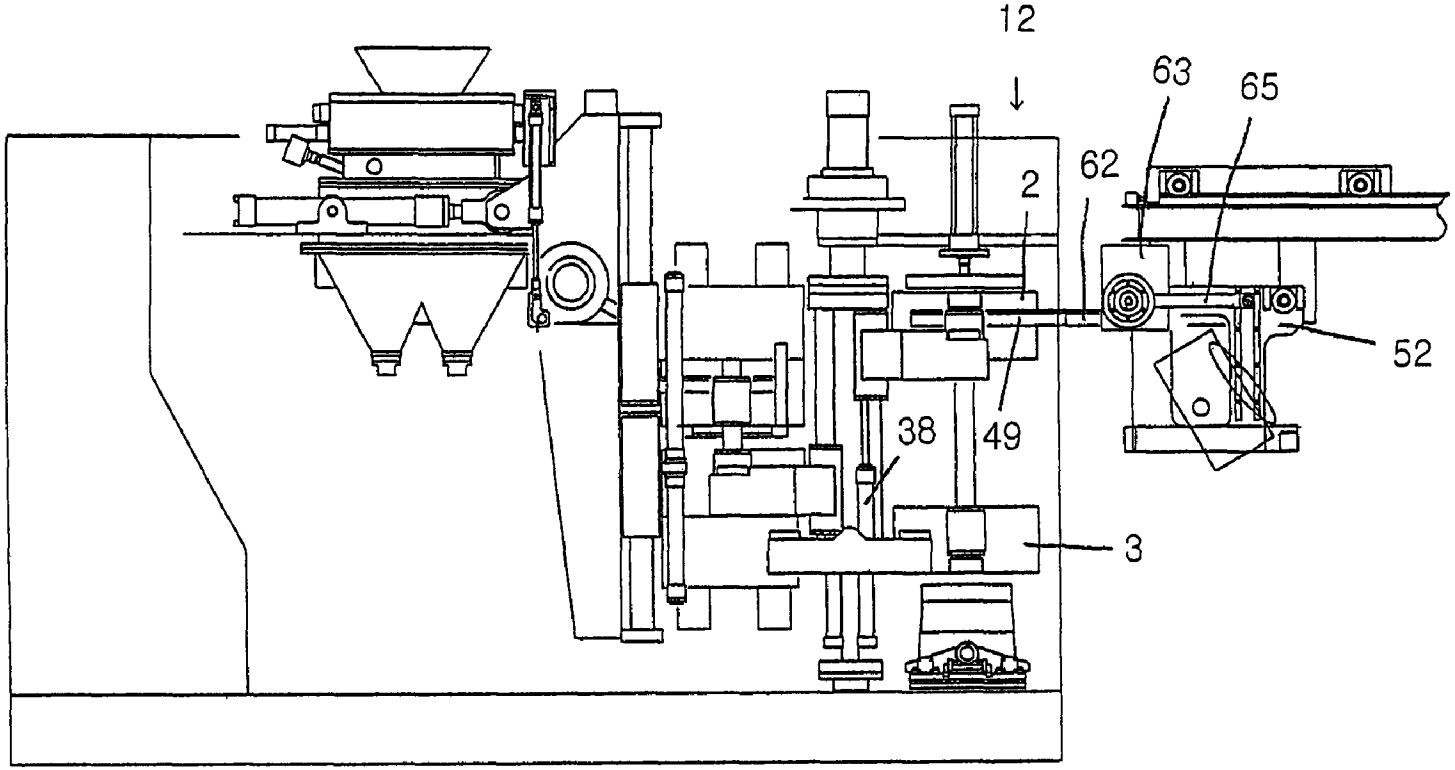
FIG. 7 is an operational view using the flaskless molding apparatus of FIG. 1.

Then, as in FIG. 7, the arm 65 is swung counterclockwise by means of the driving motor 63 to transfer the first carrier 52 from the first rails 49 of the cope flask 2 to the second rails 62. By this operation, the core setting process is completed.

Next, the cope flask 2 is stacked on the drag flask 3 by contracting the sixth cylinder 38. Then the upper and lower molds are stripped from the cope and drag flasks 2, 3 by means of the mold-stripping mechanism 12. Then, one production-cycle is completed.

The basic Japanese Patent Application, No. 2007-306722, filed Nov. 28, 2007, is hereby incorporated in its entirety by reference into the present application.

The present inventions will become more fully understood from the detailed description given below. However, the detailed description and the specific embodiment are illustrations of desired embodiments of the present inventions, and are described only for an explanation. Various possible changes and modifications will be apparent to those of ordinary skill in the art on the basis of the detailed description.

The applicant has no intention to dedicate to the public any disclosed embodiment. Among the disclosed changes and modifications, those which may not literally fall within the scope of the present claims constitute, therefore, a part of the present inventions in the sense of the doctrine of equivalents.

The use of the articles "a," "an," and "the" and similar referents in the specification and claims are to be construed to cover both the singular and the plural, unless otherwise indicated herein or clearly contradicted by the context. The use of any and all examples, or exemplary language (e.g., "such as") provided herein, is intended merely to better illustrate the inventions, and so does not limit their scope, unless otherwise claimed.

What we claim is:

1. A molding apparatus for producing an upper and a lower flaskless mold, the molding apparatus comprising:

two pairs of a cope flask and a drag flask, each pair having a sand-filling inlet on a sidewall;

a match plate to be transferred to and from the space between one of the pairs of the cope and the drag flask by a transfer mechanism;

a squeezing mechanism for squeezing molding sand, which holds the match plate between the pair of the cope and the drag flask, and has an upper and a lower squeezing means that is insertable into an opening where there is no match plate, and is constructed such that the pair of the cope and the drag flask which is holding the match plate rotates from a perpendicular position to a horizontal position in a substantially perpendicular plane around a horizontal shaft;

a rotating means to rotate the squeezing mechanism clockwise and counterclockwise;

a sand-filling mechanism to feed molding sand through the sand-filling inlet into the pair of the cope and the drag flask which is disposed at the perpendicular position by the rotating means;

a mold-stripping mechanism to strip the upper and lower molds made of the molding sand from the cope and the drag flasks which are stacked together and disposed in a horizontal state, containing the upper and lower molds;

a flask-rotation mechanism to alternately transfer the two pairs of the stacked cope and the drag flask between the squeezing mechanism and the mold-stripping mechanism in a circular motion, having a means to lift and lower the cope flask; and a core-setting apparatus having:

a core-handling tool that holds and releases a core therefrom with a clamping mechanism or a suctioning mechanism:

a first carrier which carries the core-handling tool, said first carrier being moveable between a first position where the core-handling tool is outside of the mold-stripping mechanism and a second position where the core-handling tool is under the cope flask after the cope flask is lifted by means of the flask-rotation mechanism while the cope flask is positioned at the mold-stripping mechanism;

a second carrier that supports the first carrier and the core-handling tool in the first position;

a transferring mechanism disposed on the second carrier that transfers the first carrier and the core-handling tool back and forth between the first position where the first carrier is supported by the second carrier and the second position where the first carrier is supported by the cope flask, so that in the second position the first carrier is removed from and is no longer supported by the second carrier, and a controlling means for controlling the core-handling tool and the transferring mechanism.

2. The molding apparatus of claim 1, wherein the second carrier is moveable to and from the mold-stripping mechanism.

3. molding apparatus of claim 1, including a first pair of spaced rails on the cope flask that support the first carrier for movement thereon in the second position and a second pair of spaced rails on the second carrier that support the first carrier for movement thereon in the first position, said first and second pairs of rails being aligned with each other when the cope flask is lifted by the flask-rotation mechanism, wherein the transferring mechanism transfers the first carrier back and forth between the first and second positions thereof by moving the first carrier along said aligned pairs of rails.

* * * * *

UNITED STATES PATENT AND TRADEMARK OFFICE

CERTIFICATE OF CORRECTION

PATENT NO. : 8,230,898 B2
APPLICATION NO. : 12/744471
DATED : July 31, 2012
INVENTOR(S) : Minoru Hirata et al.

It is certified that error appears in the above-identified patent and that said Letters Patent is hereby corrected as shown below:

Claim 3, Column 8, Line 52, "molding" should read -- The molding --.

Signed and Sealed this
Twenty-sixth Day of February, 2013

Teresa Stanek Rea
*Acting Director of the United States Patent and Trademark Office*